US006289770B1

(12) United States Patent
Collins

(10) Patent No.: US 6,289,770 B1
(45) Date of Patent: Sep. 18, 2001

(54) POWER WRENCH SAFETY SWITCH

(76) Inventor: Bobby Collins, 825 Holiday Ct., Kenner, LA (US) 70065

( * ) Notice: Subject to any disclaimer, the term of this patent is extended or adjusted under 35 U.S.C. 154(b) by 0 days.

(21) Appl. No.: 09/597,942

(22) Filed: Jun. 20, 2000

(51) Int. Cl.[7] ..... B25B 13/46
(52) U.S. Cl. ..... 81/57.39
(58) Field of Search ..... 81/57, 57.11–57.39

(56) References Cited

U.S. PATENT DOCUMENTS

| | | | |
|---|---|---|---|
| 418,337 | | 12/1889 | Kors . |
| 1,534,334 | | 4/1925 | Stutsman . |
| 1,950,704 | | 3/1934 | Thomson . |
| 2,242,954 | | 5/1941 | Ingwer . |
| 2,429,929 | | 10/1947 | Fisher . |
| 2,517,062 | | 8/1950 | Vosper . |
| 2,615,682 | | 12/1952 | Stone . |
| 2,634,518 | | 4/1953 | Merz . |
| 2,712,256 | | 7/1955 | Fish . |
| 2,837,177 | | 6/1958 | Edge et al. . |
| 2,855,613 | | 10/1958 | Kostka . |
| 3,031,699 | | 5/1962 | Fleury . |
| 3,683,686 | | 8/1972 | Sergan . |
| 3,706,244 | | 12/1972 | Wilmeth . |
| 3,745,858 | | 7/1973 | Biach . |
| 3,930,776 | | 1/1976 | Keller . |
| 3,995,828 | | 12/1976 | Orban . |
| 4,027,560 | | 6/1977 | Parker . |
| 4,027,561 | | 6/1977 | Junkers . |
| 4,028,868 | | 6/1977 | Zehrung, Jr. . |
| 4,060,137 | | 11/1977 | Bickford et al. . |
| 4,091,890 | | 5/1978 | Wilmeth et al. . |
| 4,095,917 | | 6/1978 | Wesner . |
| 4,141,262 | | 2/1979 | Smith . |
| 4,155,278 | | 5/1979 | Estok . |
| 4,180,144 | | 12/1979 | Adams . |
| 4,201,099 | | 5/1980 | Junkers . |
| 4,201,503 | | 5/1980 | Nannen . |
| 4,211,150 | | 7/1980 | Framberg . |
| 4,260,183 | | 4/1981 | Krupp . |
| 4,275,620 | | 6/1981 | Collins . |
| 4,308,767 | | 1/1982 | Wilmeth . |
| 4,325,274 | * | 4/1982 | Martelee ..... 81/57.13 |
| 4,333,365 | * | 6/1982 | Perry ..... 81/57.16 |
| 4,336,727 | | 6/1982 | Junkers . |
| 4,385,533 | | 5/1983 | Collins . |
| 4,408,363 | | 10/1983 | Doree . |
| 4,414,701 | | 11/1983 | Johnson . |
| 4,448,096 | | 5/1984 | Collins . |
| 4,513,645 | | 4/1985 | Grabovac et al. . |
| 4,607,546 | | 8/1986 | Wagner . |
| 4,794,825 | * | 1/1989 | Schmoyer ..... 81/57.39 |
| 5,152,196 | | 10/1992 | Garrett . |

FOREIGN PATENT DOCUMENTS

| | | |
|---|---|---|
| 671630 | 12/1929 | (FR) . |
| 972449 | 10/1963 | (GB) . |
| 579132 | 12/1975 | (SU) . |
| 2749857 | 11/1977 | (SU) . |

* cited by examiner

*Primary Examiner*—Derris H. Banks
*Assistant Examiner*—David B Thomas
(74) *Attorney, Agent, or Firm*—Roy, Kiesel, Keegan & DeNicola

(57) ABSTRACT

The present invention provides a power activated wrench with a safety switch for preventing premature activation. The power activated wrench has a wrench body with a tool head assembly and an activation arm for applying torque to the tool head assembly. An activation switch is in operative connection to the activation arm. A safety switch housing is connected to the wrench body and a contact surface connected to the safety switch housing. The proximate connection of the contact surface with a reaction point enables the activation switch.

23 Claims, 7 Drawing Sheets

POWER WRENCH SAFETY SWITCH

BACKGROUND OF THE INVENTION

1. Field of the Invention

The following invention relates in general to hydraulic torque wrenches and more particularly to a safety activation device to prevent the wrench from activating before the wrench is in a safe position.

2. Description of the Prior Art

The petro-chemical industry, as well as industry in general, relies on extensive use of pipes and large valves with bolted or studded flanges. Very large make-up torque of the magnitude of 2,500–5,000 ft-lbs rising to as high as 75,000 ft-lbs are needed to tighten down the nuts on these flanges. Additionally, the break-out torque required may be four or five times the corresponding make-up torque needed for a given flange. Consequently, heavy-duty wrenches, primarily hydraulic torque wrenches, are needed. On such hydraulic torque wrench or power wrench is disclosed in U.S. Pat. No. 4,669,338 to Collins, which is incorporated by reference herein. FIG. 1 illustrates a power wrench such as disclosed in the '338 Patent wherein the ratcheting box wrench referred to generally as 1 is positioned on a flange-nut 2 in a manner so that the wrench body 3 will contact an adjacent flange-nut 4. Flange-nut 4 provides the reaction point or base from which the ratcheting box wrench 1 will gain leverage. Wrench 1 will have some type of actuation arm which rotates tool head assembly 8. In the embodiment shown, the activation arm comprises a piston and cylinder assembly. However, other activation arms such as power screws and the like may be utilized. The hydraulic cylinder 5 is activated and its piston rod (not shown) will extend causing the front cylinder clevis 6 to make contact with the lever arm 7 of the tool head assembly 8. The front cylinder clevis 6 is connected to the lever arm 7 with a connection pin 9. As the lever arm 7 is turned by the hydraulic cylinder 5, the tool read assembly 8 rotates. This rotation is further guided by a tracking arm 10 which is an integral part of the tool head assembly 8 located between the retainer arm 11 and the lever arm 7. The tracking arm 10 moves within an arcuate channel 12 (shown by hidden lines on FIG. 1) within the wrench body 3. If this tracking arm is properly dimensioned, it will increase the wrench's ability to operate within a confined space since there will be no need to remove and reattach the wrench to the nut during the exercise of a normal ratchet cycle.

It will be understood that when hydraulic fluid flows to cylinder 5 and clevis 6 extends in the direction of force arrow 13, body 3 will be urged in the direction of force arrow 14 against the reaction point, which is flange-nut 4 in FIG. 1. Torque is thereby applied to flange nut 2 in the direction indicated by force arrow 15. Typically, the wrench is activated by an activation switch 16, which is shown schematically in FIG. 1 as handheld remote 17 with activation button 45. While not shown in detail, it is known in the art to have a hydraulic fluid source 18 which will transmit hydraulic fluid to lines 9*a* or 9*b* on cylinder 5 in order to extend clevis 6 or retract it. It is similarly well know in the art how to activate transmission of fluid with a handheld remote 17. In other words, handheld remote is in operative connection with cylinder 5.

This configuration of wrench 1 operates safely as long as body 3 is placed against or very close to flange-nut 4 prior to activating wrench 1 (i.e., applying hydraulic pressure to cylinder 5). As may happen through inattentiveness, a worker may position wrench 1 on a flange-nut 2 as seen in FIG. 2. If the wrench is a ratchet type as disclosed in the above referenced U.S. Pat. No. 4,669,388, the ratcheting mechanism will allow the user to move body 3 against flange-nut 4. This is the proper manner of positioning wrench 1 before activating hydraulic cylinder 5. However, if body 3 is not placed safely against flange-nut 4 and if wrench 1 is activated while in this position, there is no reaction point to restrain the movement of body 3 and body 3 will move toward flange-nut 4 quickly and with great force. If a worker has placed his hand or fingers between flange-nut 4 and body 3, his hand or fingers may be seriously injured or even amputated. What is needed in the art is a wrench which insures body 3 is safely against a reaction point before fluid will flow to hydraulic cylinder 5.

OBJECTS AND SUMMARY OF INVENTION

It is an object of this invention to provide a power wrench which is safer to operate than those of the prior art.

It is another object of this invention to provide a power wrench which will not activate before the wrench is properly positioned.

Therefore, the present invention provides a power activated wrench with a safety switch for preventing premature activation. The power activated wrench has a wrench body with a tool head assembly and an activation arm for applying torque to the tool head assembly. An activation switch is in operative connection to the activation arm. A safety switch housing is connected to the wrench body and a contact surface connected to the safety switch housing. The proximate connection of the contact surface with a reaction point enables the activation switch.

BRIEF DESCRIPTION OF THE DRAWINGS

FIG. 7 is a schematic of an electrical circuit used in an alternate embodiment of the present invention.

DETAILED DESCRIPTION OF THE INVENTION

Figure 3:
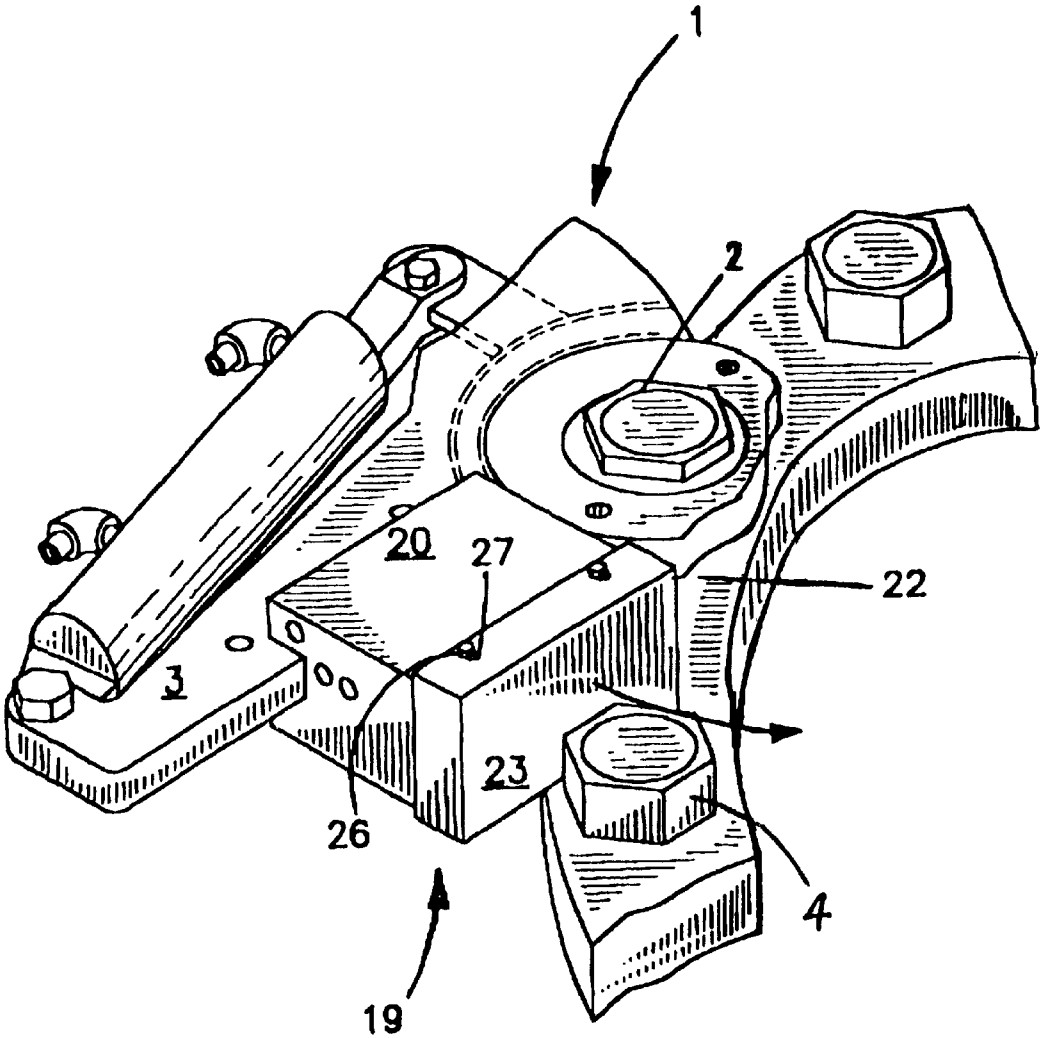
FIG. 3 illustrates the safety switch housing and contact surface positioned on a power wrench in accordance with the present invention.
Figure 5:
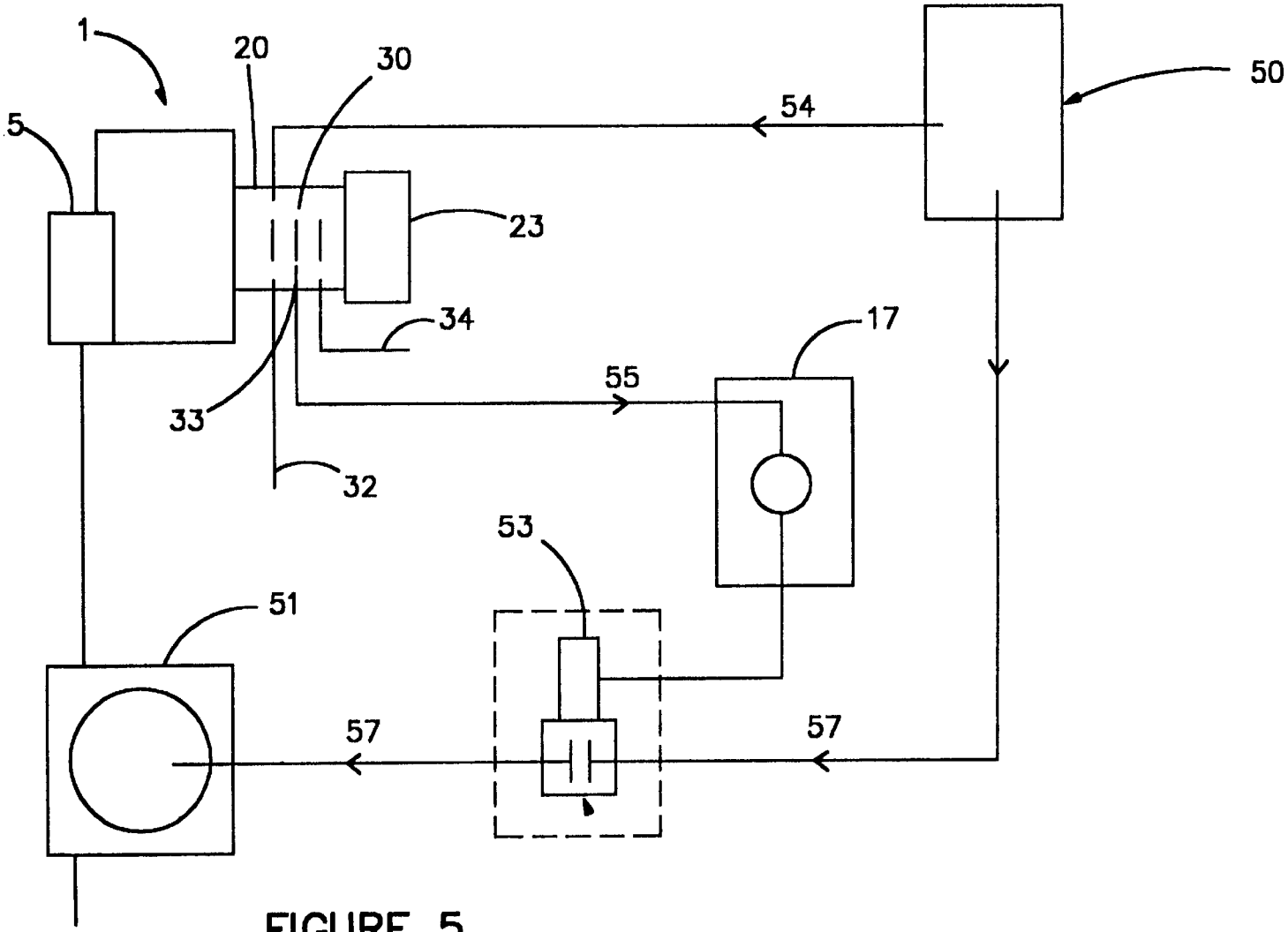
FIG. 5*a* illustrates a valve which is utilized in one embodiment of the safety switch while the switch is in the enabled position.
FIG. 5*b* illustrates the switch of FIG. 5*a* in the non-enabled position.
Figure 5B:
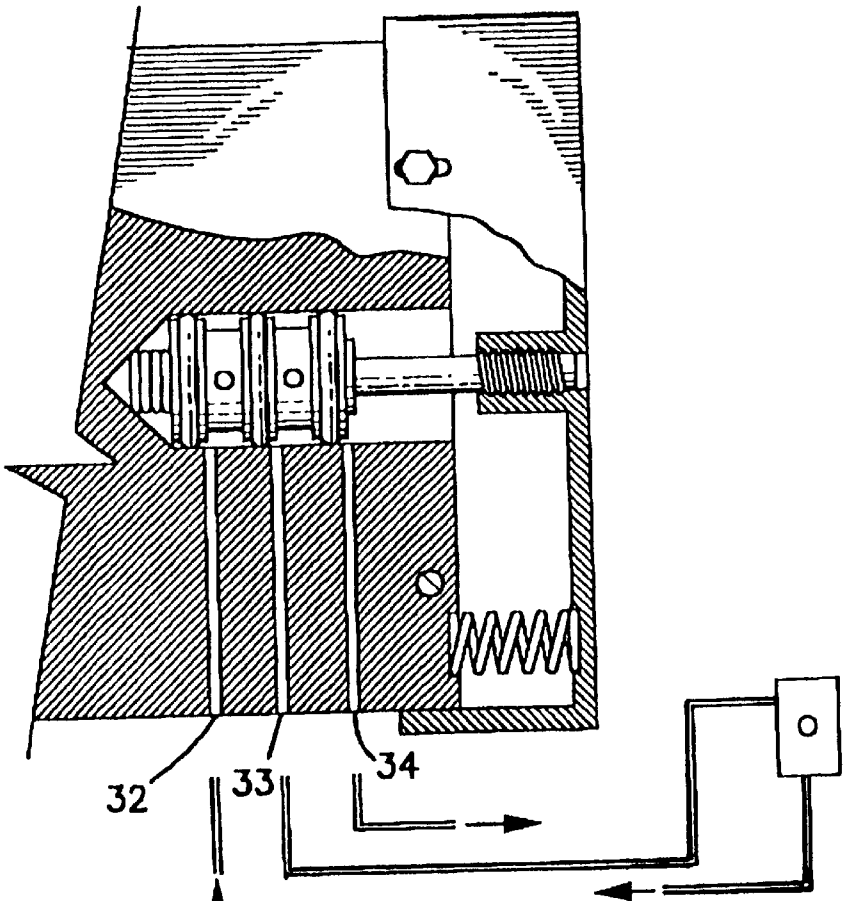
Figure 5A:
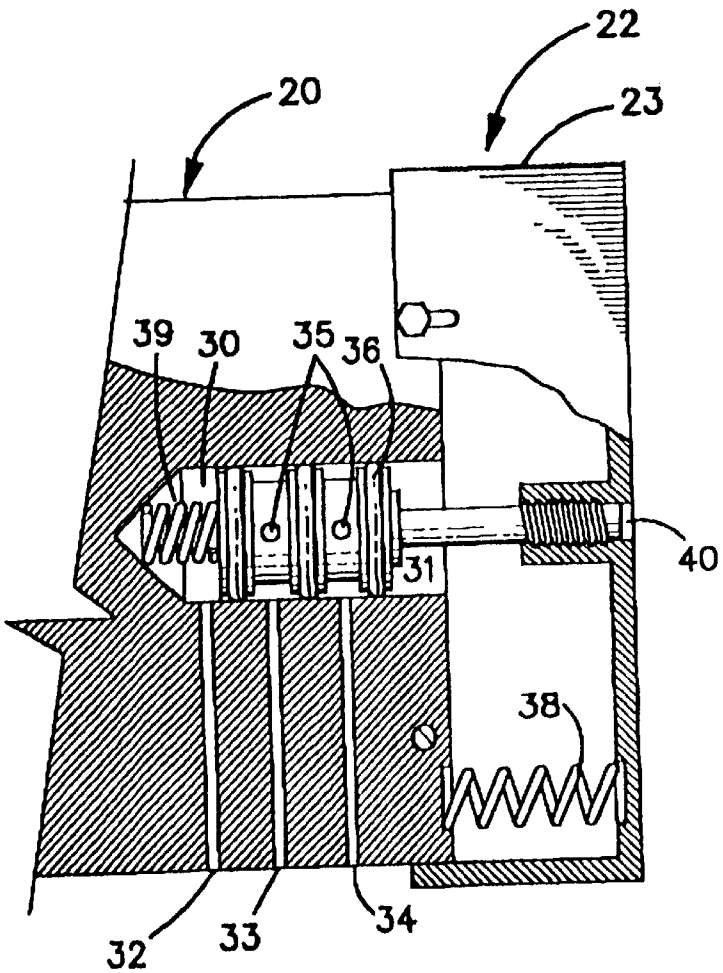

FIG. 3 illustrates the safety switch 19 of the present invention connected to body 3 of power wrench 1. Safety switch 19 generally comprises a housing 20 and a contact surface 22. In the embodiment shown in FIG. 3, contact surface 22 is a contact plate 23. In this embodiment, the edges of contact plate 23 slightly overlap the outside edge of housing 20 as best seen in FIGS. 5*a* and 5*b*. Contact plate 23 is movably secured to housing 20 by way slots 27 formed therein and a retainer 26 (such as a bolt or pin) extending through slots 27 into housing 20. While not seen in the figures, it will be understood two more slots 27 are located opposite the side seen in FIGS. 5*a* and 5*b*. Contact plate 23 is thus allowed to move toward and away from housing 20 a distance which is equal to the length of slot 27, but is biased away from housing 20 by a biasing device such as spring 38 when no external force is applied. While only one spring 38 is shown, it will be understood that a second spring 38 is hidden from view by the portion of contact plate 23 which has not been cut away in FIG. 5. By moving toward and away from housing 20, contact plate 23 activates a valve or closes an electrical circuit which will enable handheld remote 17 to activate the source of hydraulic fluid to cylinder 5. FIGS. 5*a* and 5*b* illustrate one manner in which movement of contact plate 23 activates a valve which enables handheld remote 17. FIG. 5*a* shows housing 20 with an aperture 31 formed therein. Positioned within aperture 31 is cartridge valve 30. Cartridge valve 30 includes a series of seals 36 and two apertures 35. While not shown in the figures, it will be understood that a passage within cartridge valve 30 communicates between the two apertures 35. A valve spring 39 biases cartridge valve 30 toward the opening of aperture 31. One suitable cartridge valve is available from Humphrey Products Company, located on Sprinkle Road, Kalamazoo, Mich. 49003 and is designated as model Y125IN. Housing 20 also has three apertures or passages formed therein and communicating with bore 31. As will be explained more fully below, these passages are air source passage 32, air activation passage 33 and bleeder passage 34. It can be seen in FIG. 5*a* that when pressure plate 23 is biased away from housing 20 by springs 38, the apertures 35 will be aligned with air activation passage 33 and bleeder passage 34. Thus, pressurized air may escape from air activation passage 33 through bleeder passage 34 and into the atmosphere. Similarly, when pressure plate 23 is depressed against housing 20 as seen in FIG. 5*b*, an adjustment screw 40 moves cartridge valve 30 such that air source passage 32 and air activation passage 33 are in fluid communication. Because it is necessary to position cartridge valve 30 correctly in bore 31 to insure proper alignment of the passages, adjustment screw 40 is threaded through contact plate 23 and engages cartridge valve 30. It will be readily apparent from FIGS. 5*a* and 5*b* how the advancing or backing out of adjustment screw 40 will align seals 36 and apertures 35 for proper operation of cartridge valve 30.

Figure 4:
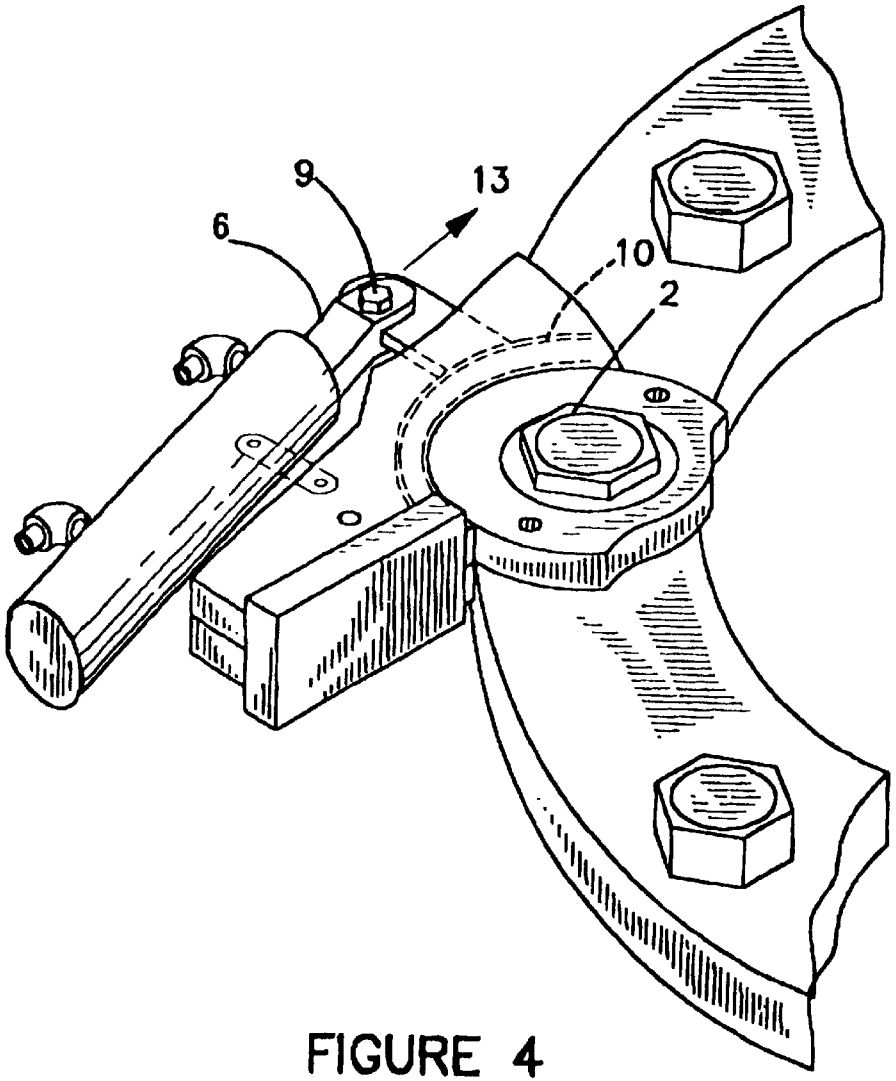
FIG. 4 illustrates a different embodiment of the safety switch in which the housing is built into the body of the wrench.

While FIG. 3 illustrates a housing 20 formed separately from body 3, an alternate embodiment seen if FIG. 4 incorporates housing 20 into body 3. In FIG. 4, body 3 has been considerably cut down and is fixed to cylinder 5 by a connector 43. Connector 43 is shown as simply a plate with screw apertures to engage cylinder 4 and body 3. Of course, connector 43 could be any means for securely fixing cylinder 5 relative to body 3. It will be clear to those skilled in the art that a housing 20 can be formed in body 3 by drilling out a bore 31 and passages 32, 33, and 34 similar to that seen in FIGS. 5*a* and 5*b*. Contact plate 23 shown in FIG. 4 will slide over the outer edge of body 3/housing 20 exactly as seen in FIGS. 5*a* and 5*b*. While not shown in FIG. 4, a small slot will be formed in body 3 adjacent to head assembly 8 in order to accommodate the inward travel of that edge of contact plate 23. The embodiment of FIG. 4 may be slightly more economical to construct than the embodiment of FIG. 3. However, FIG. 3 allows more freedom as to where to locate housing 20 along the length of body 3. This may be important in some applications because different flanges have different spacing between flange nuts. If a flange has a wide spacing between flange nuts, it may be appropriate to locate housing 20 further down body 3 than shown in FIG. 3. However, the decisions as to how to form housing 20 and where to locate it along body 3 are well within the capabilities of those skilled in the art. The important point is that both embodiments of safety switch 19 seen in FIGS. 3 and 4 operated in the manner described in relation to FIGS. 5*a* and 5*b*.

Figure 6:
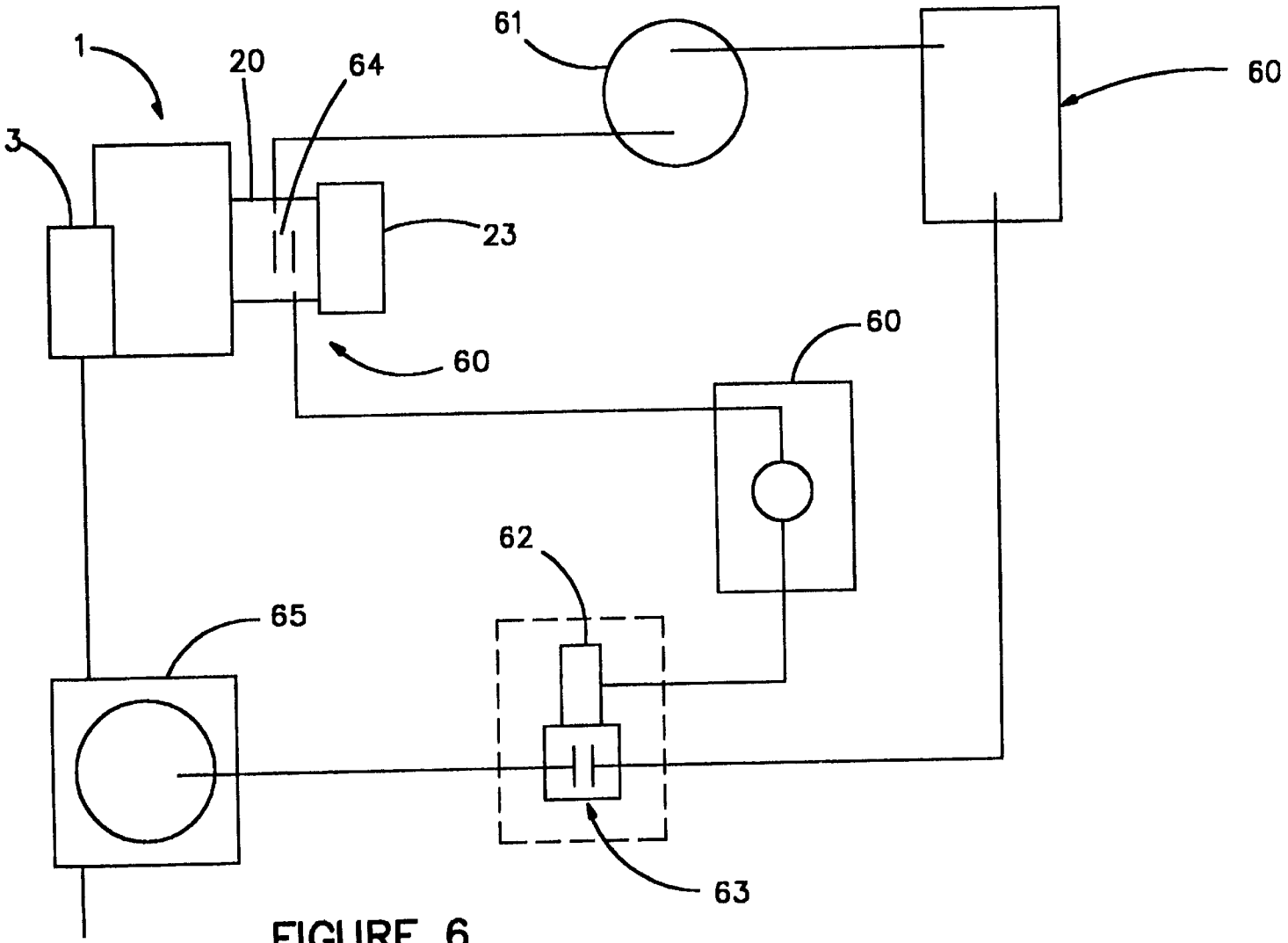
FIG. 6 is a schematic of the pressurized air circuit used in one embodiment of the present invention and the control lines operating the circuit.

The air flow schematic of FIG. 6 more clearly illustrates how the flow of air through safety switch housing 20 enables handheld remote 17 to supply hydraulic fluid to cylinder 5. While not explicitly shown in the schematic, it will be understood that FIG. 6 describes the invention with pressure plate 23 depressed and thus air source passage 32 in communication with air activation passage 33 as seen in FIG. 5*b*. Pressurized air from a conventional air source 50 (e.g. a compressor, air tank, etc.) will travel though line 54 and enter air source passage 32 and exit through air activation passage 33. Air source 50 in this embodiment is a 150 psi source, but many variations in pressure may be appropriate depending on the tools operated by the air source. Line 55 will carry this pressurized air to handheld remote 17. When handheld remote 17 is activated, pressurized air will flow therethrough and open air pilot valve 53. Air pilot valve 53 may be any commercially available pilot valve capable of carrying out the functions described herein. The opening of air pilot valve 53 will allow pressurized air from source 150 to enter conventional air motor driven hydraulic pump 51. Air motor/hydraulic pump 51 will supply the hydraulic fluid to cylinder 5 which activates wrench 1. Thus, it can be seen how air activation passage 33 acts as an enabling passage which enables handheld remote 17 to activate cylinder 5.

Figure 1:
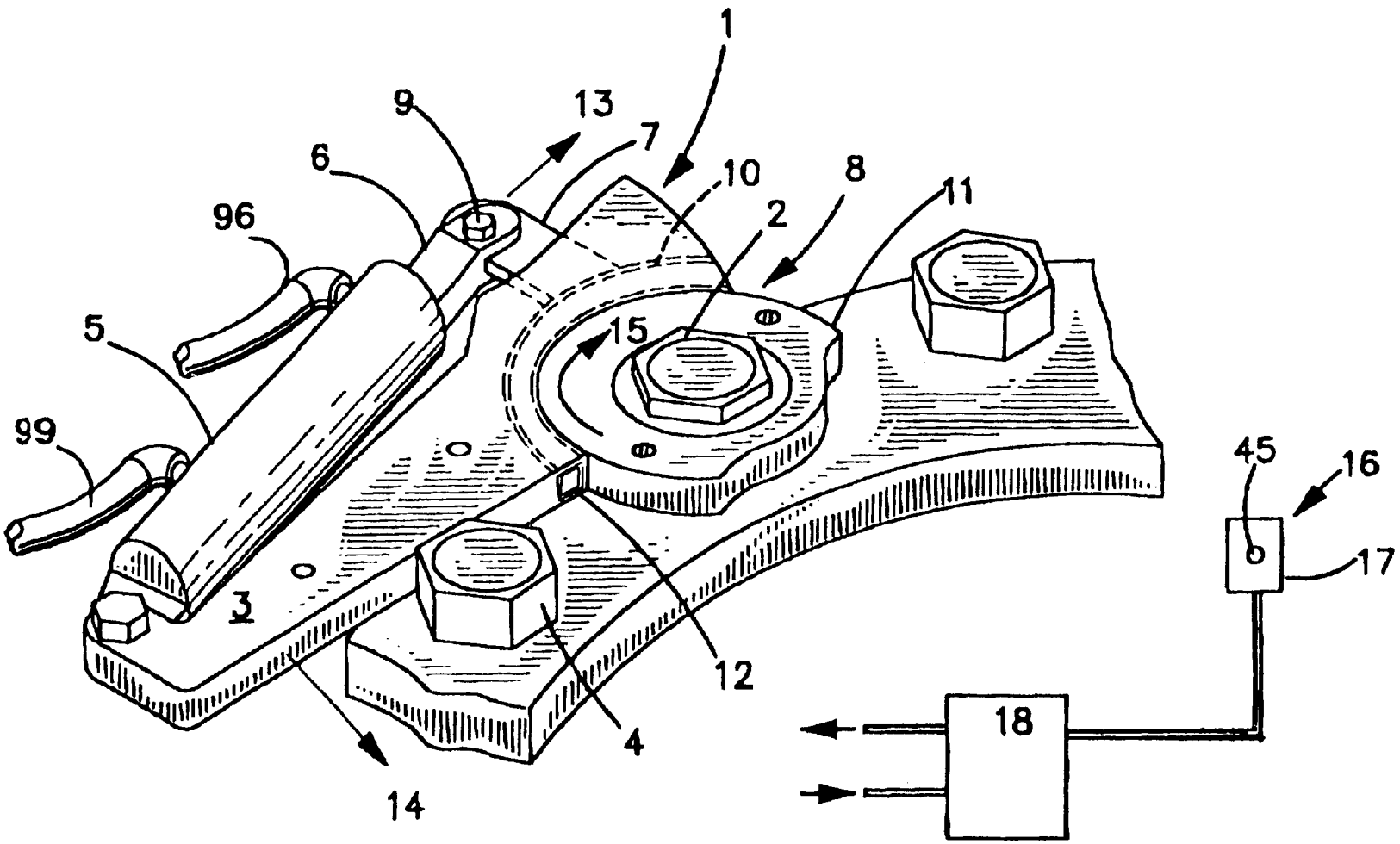
FIGURE 1 PRIOR ART
FIG. 1 illustrates a prior art power wrench properly positioned on a flange-nut and against a reaction point.
Figure 2:
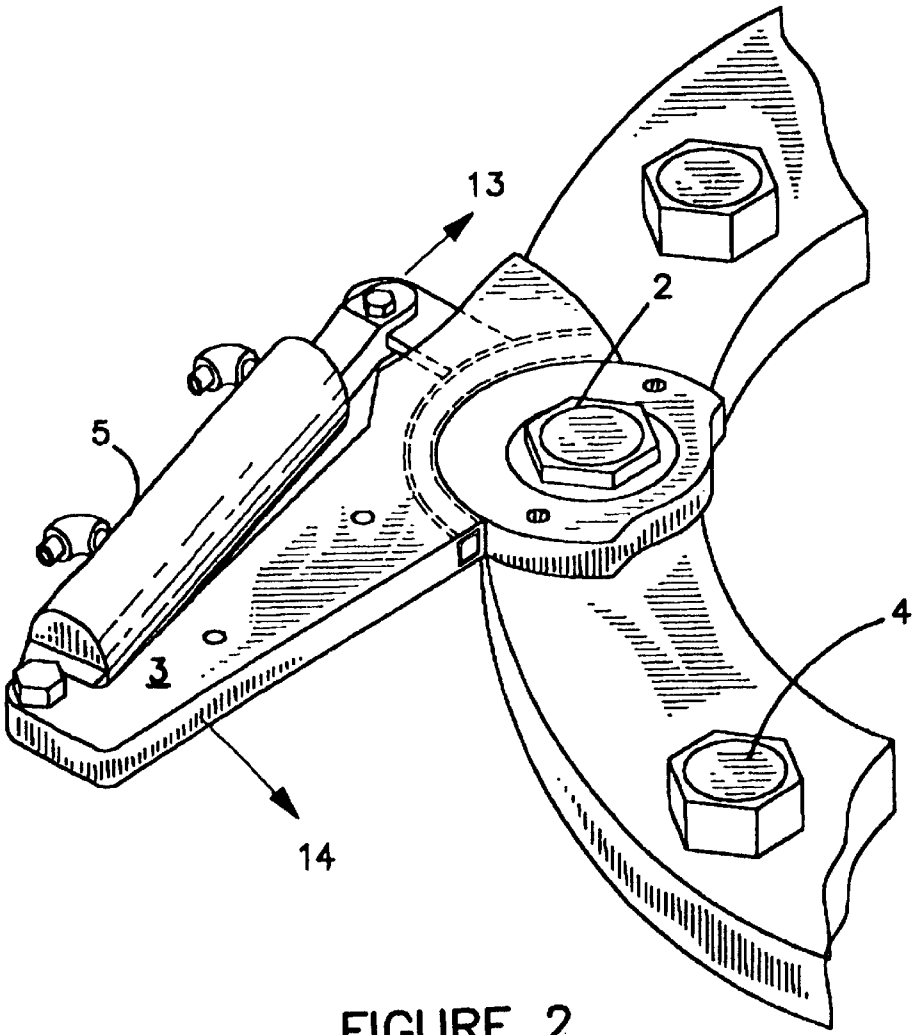
FIGURE 2 PRIOR ART
FIG. 2 illustrates the improper positioning of the power wrench away from the reaction point.

As shown in FIG. 5*a*, when pressure plate 23 is not depressed, air activation passage 33 is connected to bleeder passage 34. This allows pressurized air in line 55 of FIG. 6 to exhaust to the atmosphere. Thus, even if handheld remote 17 is activated, as long as pressure plate 23 is not depressed, no pressurized air will flow to air pilot valve 53 and no air activates air motor hydraulic pump 51. Therefore, when a power wrench equipped with safety switch 19 (FIG. 3) is positioned incorrectly on a flange-nut 2 as seen in FIG. 2, the activation of handheld remote 17 will not activate the power wrench. The power wrench may only be activated when the pressure plate is positioned against a reaction point such as seen in FIG. 3.

Nor is the present invention limited to systems using pressurized air. FIG. 7 illustrates an electrically controlled circuit for safety switch 19. The circuit of FIG. 7 generally comprises a higher voltage source 60 (110 volts in the embodiment of FIG. 7), a transformer 61 stepping down the higher voltage to a lower voltage (stepped down to 24 volts in the embodiment of FIG. 7), solenoid switch 62 and electric motor/hydraulic pump 65. In this embodiment, housing 20 will include two electrical contacts 64. One electrical contact is connected to the 24 volt transformer output and the other electrical contact connects with handheld remote 17. The depressing of pressure plate 23 will bring contacts 64 together and allows the 24 volts to be applied to the switch in handheld remote 17. On activation of remote 17, solenoid switch 62 will bring electrical contacts 63 together. As suggested by FIG. 7, the closing of contacts 63 will cause the 110 volts to be applied to electric motor/hydraulic pump 65, which will supply fluid to cylinder 3 and activate wrench 1. As with the circuit of FIG. 6, handheld remote 17 in FIG. 7 is not enabled to activate solenoid 62 and cause voltage to reach electric motor/hydraulic pump 65 unless pressure plate 23 is depressed. It will be understood that transformer 61 and solenoid 62 are not strictly needed and that 110 volts could be directly applied to contacts 64, handheld remote 17, and motor/pump 65. However, there are safety benefits to applying only 24 volts to the equipment handled by workers such as wrench 1 and handheld remote 17.

It will be understood that the two circuits seen in FIG. 6 and FIG. 7 are merely illustrative and the same function could be accomplished with an infinite number of variations in such circuits. Nor is the invention considered limited to circuits which are activated by pressure plates or any other device which physically moves toward and away from housing 20. Rather pressure plate 23 is just one example of a contact surface 22 (FIG. 3) which may be used to enable an activation switch 16 such as handheld remote 17. Such contact surfaces 22 could include any sensor which senses a reaction point near contact surface 22; e.g. magnetic sensors, light sensors or other devices. All that is necessary is that contact surface 22 only enable activation switch 16 when contact surface 22 is sufficiently close to a reaction point that a worker's fingers or hands cannot easily be placed between the contact surface 22 and the reaction point. Thus, a proximate connection (i.e. actual contact or very close to contact) of contact surface 22 and a reaction point could enable activation switch 19. Additionally, the fact that the embodiments shown in the figures only illustrate the invention applied to a wrench should not be construed as a limitation. It will be understood that the invention could be applied to other power tools which should be positioned against a reaction point in order to be safely operated. Thus, while the preferred embodiments have been described, it will be appreciated by those skilled in the art that modifications, changes, and improvements may be made without departing from the spirit of the invention defined by the claims.

I claim:

1. A power activated wrench with a safety switch for preventing premature activation, said power activated wrench comprising:

a. a wrench body having a tool head assembly and an activation arm for applying torque to said tool head assembly;

b. an activation switch in operative connection to said activation arm;

c. a safety switch housing connected to said wrench body; and d. a contact surface connected to said safety switch housing, whereby proximate connection of said contact surface with a reaction point enables said activation switch.

2. A power activated wrench with a safety switch according to claim 1, wherein said housing includes a valve which is activated by said contact surface in order to enable said activation switch.

3. A power activated wrench with a safety switch according to claim 1, wherein said contact surface is a pressure plate which moves toward said housing to enable said activation switch.

4. A power activated wrench with a safety switch according to claim 3, wherein said housing includes a valve which is activated by said pressure plate in order to enable said activation switch.

5. A power activated wrench with a safety switch according to claim 4, wherein said valve is a cartridge valve.

6. A power activated wrench with a safety switch according to claim 2, wherein said valve is a cartridge valve.

7. A power activated wrench with a safety switch according to claim 4, wherein said valve selectively connects a supply passage with an enabling passage and an enabling passage with a bleeder passage.

8. A power activated wrench with a safety switch according to claim 2, wherein said valve selectively connects a supply passage with an enabling passage and an enabling passage with a bleeder passage.

9. A power activated wrench with a safety switch according to claim 2, wherein a biasing device on said housing biases said pressure plate away from said housing.

10. A power activated wrench with a safety switch according to claim 7, wherein activation of said valve connects said supply passage with said enabling passage and release of said valve connects said enabling passage with said bleeder passage.

11. A power activated wrench with a safety switch according to claim 3, wherein said pressure plate overlaps said housing.

12. A power activated wrench with a safety switch according to claim 2, wherein a power source is connected to said activation switch.

13. A power activated wrench with a safety switch according to claim 12, wherein said power source is compressed air.

14. A power activated wrench with a safety switch according to claim 13, wherein said activation arm comprises a hydraulic cylinder and piston assembly.

15. A power activated wrench with a safety switch according to claim 4, wherein an adjustment screw passes through said pressure plate and engages said valve.

16. A power activated wrench with a safety switch according to claim 1, wherein said housing includes an electrical circuit which is closed by said contact surface in order to enable said activation switch.

17. A power activated wrench with a safety switch according to claim 16, wherein said contact surface is a pressure plate which closes said circuit by moving two electrical contacts together.

18. A power activated wrench with a safety switch according to claim 3, wherein said pressure plate close a circuit by moving two electrical contacts together.

19. A power activated wrench with a safety switch according to claim 1, wherein said activation switch is a handheld remote.

20. A power activated wrench with a safety switch according to claim 4, wherein a biasing device on said housing biases said pressure plate away from said housing.

21. A power activated wrench with a safety switch according to claim 18, wherein a biasing device on said housing biases said pressure plate away from said housing.

22. A circuit used in combination with a power activated tool to prevent premature activation, said circuit comprising:

a. an activation switch adapted for operative connection with an activation arm of a power activated tool;

b. a safety switch housing adapted for connect with a power activated tool;

c. a contact surface connected to said safety switch housing, whereby proximate connection of said contact surface with a reaction point enables said activation switch.

23. A power activated tool with a safety switch for preventing premature activation, said power activated tool comprising:

a. a tool body having a tool head assembly and a means for applying torque to said tool head assembly;

b. a means for activating said means for applying torque;

c. a means for enabling said activating means when a contact surface in brought into proximate connection with a reaction point.

* * * * *